United States Patent [19]

Jones

[11] Patent Number: 4,634,158

[45] Date of Patent: Jan. 6, 1987

[54] DOOR BRACE ASSEMBLY

[76] Inventor: Aroll A. Jones, 4 Pandanus South Fin, F.P.O., San Francisco, Calif. 96630

[21] Appl. No.: 682,997

[22] Filed: Dec. 18, 1984

[51] Int. Cl.[4] ..... E05C 17/50

[52] U.S. Cl. ..... 292/260

[58] Field of Search ..... 292/259, 260, 251.5, 292/201, 341.16, DIG. 46, DIG. 73

[56] References Cited

U.S. PATENT DOCUMENTS

| | | | |
|---|---|---|---|
| 181,269 | 8/1876 | Keese et al. | 292/260 |
| 1,739,911 | 12/1929 | McMurray | 292/259 |
| 2,421,275 | 5/1947 | Lopez | 292/259 |
| 2,472,397 | 6/1949 | Bennett | 292/251.5 |
| 4,082,332 | 4/1978 | Palmer | 292/259 R |

*Primary Examiner*—Richard E. Moore

*Attorney, Agent, or Firm*—Harrington A. Lackey

[57] ABSTRACT

A brace assembly for a door including an elongated brace bar hingedly mounted at one end to the door frame to permit the brace bar to swing about two perpendicular axes, and means for securing the other end of the brace bar to the door frame when the brace bar spans the door in operative position. A pressure control device is mounted on the mid-portion of the brace bar for positively and adjustably exerting pressure against the door in closed position when the brace bar is in operative position, in order to stabilize the door in a rigid closed position.

3 Claims, 4 Drawing Figures

DOOR BRACE ASSEMBLY

BACKGROUND OF THE INVENTION

This invention relates to a door brace assembly, and more particularly, to a door brace assembly for stabilizing a door in closed position.

Door braces or door bars, spanning a door frame for securing a door in closed position, are well known in the art. Examples of these door brace structures are disclosed in the following U.S. patents:

| | | |
|---|---|---|
| 284,961 | Hill | Sep. 11, 1883 |
| 315,681 | Von Hollen | Apr. 14, 1885 |
| 786,837 | Pollard | Apr. 11, 1905 |
| 2,163,206 | Lopez | Jun. 20, 1939 |
| 3,592,497 | Logan | Jul. 13, 1971 |
| 3,919,807 | Mefford | Nov. 18, 1975 |
| 4,067,598 | Mansour | Jan. 10, 1978 |
| 4,082,332 | Palmer | Apr. 4, 1978 |

The patents to Hill, VonHollen and Mansour disclose door braces having one end mounted for pivotal movement in a single plane about a door or window frame.

The patents to Lopez, Logan and Mefford, disclose a door brace having one end journaled to the door frame for pivotal movement about either of two perpendicular axes. These journaled mechanisms permit the door bar to swing toward and away from the door, as well as in a plane parallel to the door.

The patents to Pollard, Mansour and Palmer disclose various types of pressure devices for exerting pressure between the door bar and the door. The Pollard patent discloses a spring-biased cap 19, for exerting pressure against the door. Mansour discloses a padded clip 70, and Palmer discloses a resilient cylinder 40, for exerting pressure between the door brace or bar, and the door.

Several of the above patents disclose various locking devices for locking the brace bar in its operative position against the door frame.

However, none of the above patents disclose a pressure controlled device adapted to exert positively controlled pressure between a door brace and a door in order to rigidly secure a door in a stable position, under varying conditions.

SUMMARY OF THE INVENTION

It is therefore an object of this invention to provide a door brace assembly including a door brace bar provided with a pressure control unit for exerting pressure upon the door to stabilize the door under varying conditions, such as the size, structure and suspension of the door as well as against external forces caused by weather or persons.

One object of this invention is to provide a door brace assembly particularly adapted for stabilizing a door in closed position, to prevent it from rattling, particularly from the force of the wind.

Another object of this invention is to provide a brace assembly for the exterior door of a building, including an elongated,C brace bar, one end of which is pivotally connected to one side of the door frame and the opposite end of the brace bar is detachably secured to the opposite side of the door frame, while an adjustable pressure control unit mounted on the middle portion of the brace bar exerts a predetermined pressure against the mid-portion of the door to hold the door in a rigid closed position.

Another object of this invention is to provide a door brace assembly having a pressure control unit exerting pressure between the brace bar in its operative position and the door in its closed position, in order to stabilize the door in a rigid posture, and is also provided with means for pivotally supporting one end of the brace bar on one side of the door frame for pivotal movement about either of two perpendicular pivotal axes, while the opposite end of the brace bar is magnetically secured to the other side of the door frame.

DESCRIPTION OF THE PREFERRED EMBODIMENTS

Figure 1:
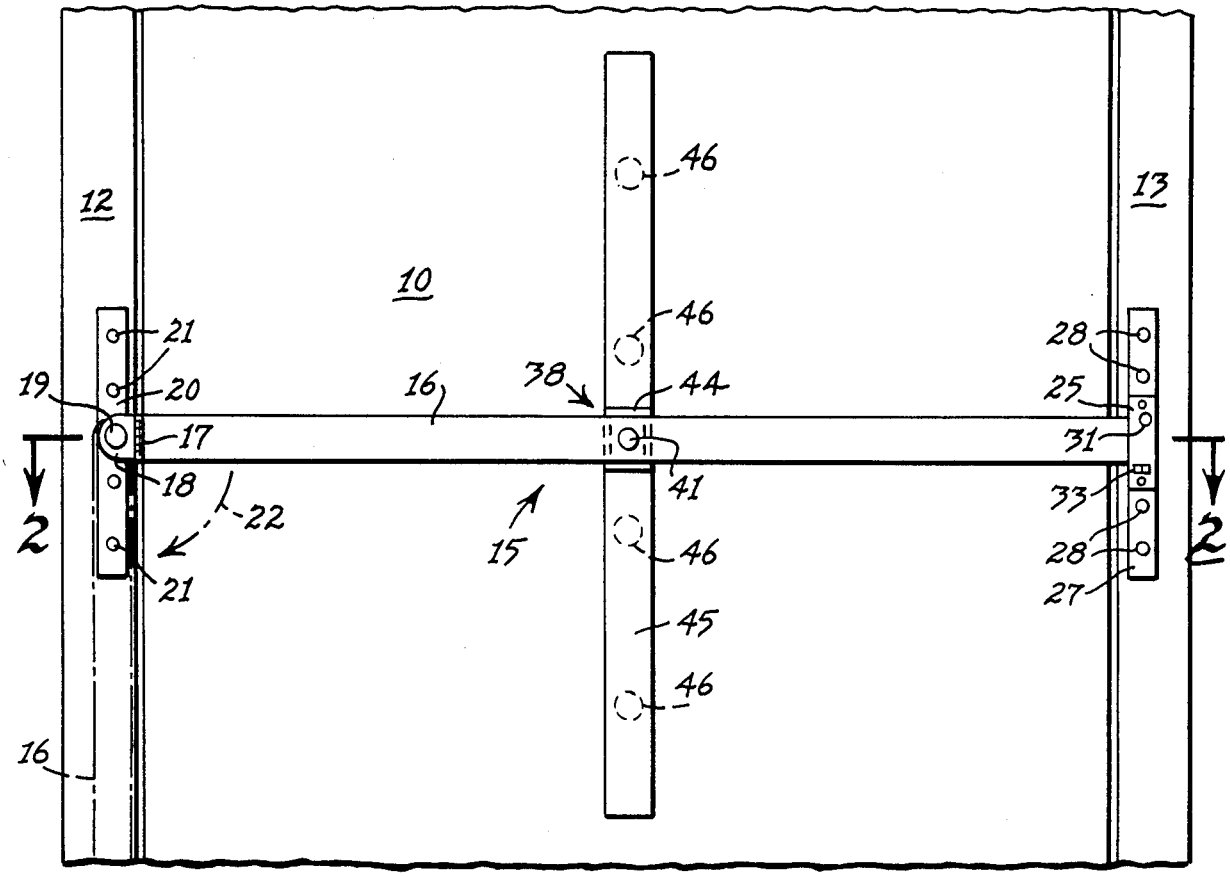
FIG. 1 is a fragmentary elevational view taken from the interior of a building illustrating the brace assembly in its operative position.
Figure 2:
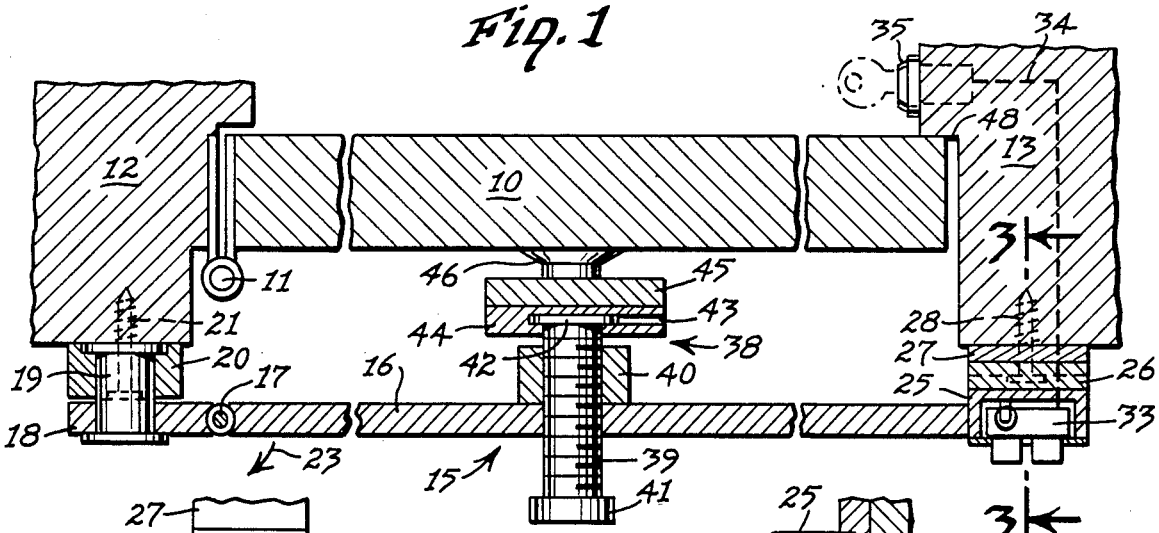
FIG. 2 is an enlarged fragmentary section, taken along the line 2—2 of FIG. 1, with parts broken away.
Figure 4:
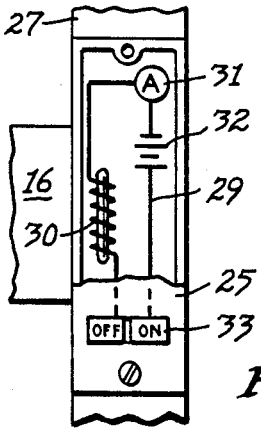
FIG. 4 is an enlarged fragmentary view, taken from the interior of the building, of the electromagnetic securing means, with portions broken away.
Figure 3:
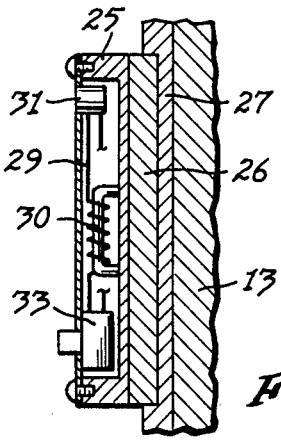
FIG. 3 is a fragmentary section taken along the line 3—3 of FIG. 2.

Referring now to the drawings in more detail, FIGS. 1 and 2 disclose an exterior door 10 mounted along one edge by hinges 11 to a vertical first door or hinge jamb 12, and adapted to swing between an open position and a position closing the door opening between the jambs 12 and 13.

The brace bar assembly 15 made in accordance with this invention, includes an elongated brace bar 16 adapted to transversely span the door opening containing door 10. The first or hinged end of the brace bar 16 is journaled by a hinge member 17, to a hinge bracket 18. The hinge bracket 18 is in turn journaled about a journal post 19 fixed to a vertical hinge frame bar 20, fixedly secured to the first door jamb 12 by means such as screws 21. It will be noted that the hinge bracket 18 is adapted to pivot or swing about the horizontal axis of the journal post 19 which is perpendicular to the door 10 in its closed position. Thus, the hinge bracket 18 is adapted to swing in a plane parallel to the closed door 10. The brace bar 16 is journaled about the hinge bracket 18 to swing about the pivotal axis of the hinge member 17, which is perpendicular to the pivotal axis of the journal post 19. Accordingly, the brace bar 16 is mounted to swing in the direction of the arrow 22 in FIG. 1, or the arrow 23 in FIG. 2. When the brace bar 16 swings downwardly in the direction of the arrow 22, it will drop to a vertical inoperative position illustrated by the dashed lines out of the way of the door frame to permit free swinging of the door 10 to an open position.

The hinge member 17 permits the brace bar 16 to be swung in the direction of the arrow 23, in a more lateral or horizontal direction, also to permit free swinging movement of the door 10 to an open position.

The opposite end of the brace bar 16 carries an electromagnetic latch member 25. The latch member 25 is so located upon the free end of the brace bar 19 that it will register with a magnetic keeper, such as the permanent magnet keeper 26, fixed on the vertical latch frame bar 27, which is attached to the door jamb 13 by means such as wood screws 28.

The electromagnetic latch member 25, may include an electromagnetic circuit 29 including an electromagnetic coil 30 connected in series with an ammeter 31, a voltage source, such as a battery 32, and a manual off-on switch 33. As disclosed in FIG. 2, in addition to, or instead of, the manually controlled electric switch 33, the circuit 29 may be connected through lead 34 to an outside key-operated switch 35, to permit the electromagnetic latch member 25 to be actuated and deactuated from the exterior of the door 10, by an authorized person.

Mounted upon and between the brace bar 16 and the inside surface of the door 10 is a pressure control device 38. The pressure control device 38 includes an elongated threaded pressure member or bolt 39 extending through a corresponding opening within the mid-portion of the brace bar 16 and threadedly engaging an internally threaded collar 40 fixed to the rear surface of the brace bar 16. The front or inside end of the pressure bolt 39 terminates in a turning knob or wheel 41 to permit manual turning of the bolt 39 relative to the collar 40 to advance or retract the pressure bolt 39 toward and away from the door 10.

The rear or outer end of the pressure bolt 39 terminates in an enlarged circular flange 42 adapted to freely rotate within a corresponding recess 43 of a stationary bearing pad member 44.

The bearing pad member 44 may be rigidly fixed to or independent of an elongated vertical pressure bar 45 secured to the inside or front surface of the door 10. As disclosed in the drawings, the pressure bar 45 is secured to the front surface of the door 10 by a plurality of vertically spaced suction cups 46. The pressure bar 45 distributes the force exerted upon it from the pressure bearing member 44 and the pressure bolt 39, over a broad surface of the door 10.

If desired, the pressure bearing member 44, may be secured directly to the door 10, or secured within a recess within the door 10, thereby eliminating the necessity of the pressure bar 45.

By advancing the pressure bolt 39 toward the door 10 and relative to the brace bar 16, the bolt 39 is rotated relative to the bearing pad member 44 to exert pressure upon the door 10 through the pressure bar 45. The force exerted upon the interior surface of the door 10 presses the door 10 against the ledge 48 of the jamb 13, and through the hinges 11 against the door jamb 12. Thus, the door 10 is reinforced to make it stronger and more rigid, to minimize rattling or vibrations, caused by weather or high winds, and is also more resistent to any forced or unauthorized entry.

In the operation of the brace assembly 15, the vertical frame bars 20 and 27 are initially secured by their respective screws 21 and 28 to the respective door jambs 12 and 13, with the proper transverse alignment. The vertical pressure bar 45 is also secured to the mid-portion of the interior surface of the door 10 so that the pressure bar 45 extends both above and below the horizontal plane of the brace bar 16.

The brace bar 16, initially hanging in its dashed line position of FIG. 1, is pivoted in its vertical plane upward, parallel to the closed door 10 until the magnetic latch member 25 registers with the magnetic keeper 26. The manual switch 33 is turned to its "on" position to close the electromagnetic circuit 29 thereby creating a magnetic force to securely hold the latch member 25 against the permanent magnet keeper 26.

The control device 38 is operated by manually turning the knob 41 to advance the pressure bolt 39 toward the door 10 until the desired amount of pressure is exerted against the door 10 to maintain it in a rigid position. The amount of pressure will be determined by the structure, strength, size and fit of the door and the degree of wind force exerted on the outside of the door 10, when the pressure control device 38 is utilized to stabilize the door 10 against rattling. If the door 10 is poorly constructed, thin, not properly hinged, or not properly fitting its door frame, then relatively more pressure must be exerted upon the door 10 by the advancement of the pressure bolt 39, in order to minimize or eliminate vibrations of the door 10 resulting from external wind forces.

The brace assembly 15 may also be used with a door 10 to reinforce the door 10 against illegal or forced entry.

When it is desired to open the door 10 from the inside, the manual switch 33 is merely turned to its "off" position to deenergize the magnetic coil 30. The turning knob 41 may also be reverse-rotated to relieve the pressure of the pressure bar 45 against the door 10. If the bearing pad member 44 is separate from the pressure bar 45, the pressure bolt 39 is withdrawn sufficiently to relieve the pressure against the pressure bar 45 and to eliminate friction between the pressure bar 45 and the pressure bearing pad 44, to permit the brace bar 16 to be swung away from the door 10 about the hinge member 17. The brace bar 16 may then be rotated downwardly about the axis of the journal post to permit the pressure bar 16 to hang in its dotted-line position of FIG. 1.

If the bearing pad member 44 is fixed to the pressure bar 45, then the pressure bolt 39 should be withdrawn sufficiently to minimize pressure against the door 10 and permit the suction cups 46 to be removed from the door 10 to permit the brace bar 16 and the pressure control device 38 to be moved away from the door 10. The door 10 may then be opened and closed at will.

If an external key-actuated switch 35 is utilized, then an authorized person on the exterior of the building may insert the key in the switch 35 to de-energize the electromagnetic latch member 25 to permit the door 10 to be opened from the outside, provided the pressure exerted by the control device 38 against the door 10 is not so great that the suction cannot be broken between the suction cup 46 and the interior surface of the door 10, when the door 10 is pushed inward.

It is therefore apparent that a door brace assembly 15 has been devised which will successfully eliminate, or at least minimize, the rattling of exterior doors in dwellings or buildings subjected to moderate to high wind forces and particularly for doors which are old and ill-fitting within their respective door frames.

The door brace assembly 15 made in accordance with this invention is also a highly effective door re-inforcement accessory for the prevention and deterrence of illegal or forceable entry by unauthorized personnel.

What is claimed is:

1. A door brace assembly comprising:

(a) an exterior door frame in a building, having first and second opposed vertical door jambs, (b) an exterior door hung in said door frame, (c) an elongated brace bar longer than the width of said door, and having first and second end portions, (d) hinge means connecting said first end portion to said first door jamb to permit said brace bar to extend transversely of said door frame and be spaced from said door in an operative position, and to permit said brace bar to swing to an inoperative position, (e) magnetic securing means on said second end portion, (f) a latch frame bar fixed to said second door jamb, (g) a magnetic keeper fixed to said latch frame bar, said magnetic keeper and said magnetic securing means being magnetically attracted to each other to secure said door brace to said latch frame bar in said operative position, a pressure control device comprising a pressure member having an operative end, (i) means operatively mounting said pressure member on said brace bar for positive movement toward and away from the door when said brace bar is in said operative position, (j) said operative end comprising a bearing pad member adapted to engage said door, and (k) said pressure control device further comprising means for moving said pressure member toward said door, in said operative position, for forcing said bearing pad member against said door.

2. The invention according to claim 1 in which said magnetic means comprises electromagnetic latch means, and means for energizing and de-energizing said electromagnetic means.

3. The invention according to claim 1 in which said hinge means comprises a hinge frame bar fixed to said first door jamb, a journal post having a horizontal journal axis projecting from said hinge frame bar away from said door frame, a hinge bracket journaled about said post for swinging movement about said horizontal journal axis, a hinge having a hinge axis connecting said hinge bracket to the first end portion of said brace bar, whereby said brace bar may swing about said hinge axis and said journal axis, said axes being perpendicular to each other.

* * * * *